US005685248A

United States Patent [19]

Stewart et al.

[11] Patent Number: 5,685,248

[45] Date of Patent: Nov. 11, 1997

[54] BIAS CORRECTION DEVICE FOR A TEXTILE STRIP

[75] Inventors: Parks C. Stewart; Robert A. Trobaugh, III, both of Duluth, Ga.

[73] Assignee: Phoenix Automation Inc., Atlanta, Ga.

[21] Appl. No.: 719,322

[22] Filed: Sep. 25, 1996

Related U.S. Application Data

[62] Division of Ser. No. 422,358, Apr. 14, 1995, Pat. No. 5,619,942.

[51] Int. Cl.[6] ..... D05B 21/00

[52] U.S. Cl. ..... 112/470.07; 226/19

[58] Field of Search ..... 112/306, 470.07, 112/475.03; 26/51.4, 51.5; 226/19, 21, 22, 23

[56] References Cited

U.S. PATENT DOCUMENTS

| | | | |
|---|---|---|---|
| 3,591,064 | 7/1971 | Wyatt | 226/22 |
| 3,640,235 | 2/1972 | Burton . | |
| 3,970,017 | 7/1976 | Babson et al. . | |
| 4,061,222 | 12/1977 | Rushing | 226/23 |
| 4,074,640 | 2/1978 | Chano et al. | 112/470.03 |
| 4,204,619 | 5/1980 | Damour | 226/21 |
| 4,565,362 | 1/1986 | Wiley . | |
| 4,608,936 | 9/1986 | Ball et al. . | |
| 4,615,287 | 10/1986 | Henze et al. . | |
| 4,621,585 | 11/1986 | Ball et al. . | |
| 4,685,408 | 8/1987 | Frye . | |
| 4,726,501 | 2/1988 | Wiley . | |
| 4,955,307 | 9/1990 | Kolb et al. . | |
| 5,031,553 | 7/1991 | Henze et al. . | |
| 5,033,399 | 7/1991 | Miyachi et al. | 112/142 |
| 5,042,409 | 8/1991 | Tanaka | 112/306 |
| 5,131,339 | 7/1992 | Goodridge . | |
| 5,554,262 | 9/1996 | Turner | 162/198 |

*Primary Examiner*—Andy Falik
*Attorney, Agent, or Firm*—Jones & Askew

[57] ABSTRACT

A device to remove any bias in the position of a cut line on a continuous strip of cloth. The device has at least two detecting devices located along a predetermined path to detect the position of the cut line and a straightening bar to tilt the continuous strip to compensate for the bias.

9 Claims, 8 Drawing Sheets

BIAS CORRECTION DEVICE FOR A TEXTILE STRIP

This is a division of application Ser. No. 08/422,358, filed Apr. 4, 1995, now U.S. Pat. No. 5,619,942.

TECHNICAL FIELD

This invention relates to a method and apparatus for finishing the edges of a textile product. More particularly, the invention measures, cuts, and stitches the edges of a textile product such as a washcloth.

BACKGROUND OF THE INVENTION

The finishing process for high quality textiles such as washcloths generally has been performed manually because of the attention to detail that is required. The edges of a washcloth must be sewn to prevent fraying and to produce a desirable and lasting product. The process is therefore labor-intensive and time-consuming.

In the manual finishing process, each individual washcloth is cut from a strip of material. The material, typically terry cloth, comes in a continuous strip with transverse borders or "cut lines" present in the fabric at equally spaced intervals along the length of the strip. The cut line is generally an area in the cloth without any terry loops or plush material that represents where each individual washcloth is to be cut from the strip.

After each washcloth is cut, an operator maneuvers the washcloth around a sewing head to stitch or over-edge the sides. A high amount of operator skill is required to produce a washcloth with four uniform sides because the dimensions of each side of the material can often vary. Rounded-comer washcloths are particularly difficult to finish because each comer of the washcloth must be rounded in a uniform fashion. UPC labels, cloth loop labels, or single-ply labels also may be added to the edges of the washcloth.

While attempts have been made to automate the washcloth finishing process, these attempts have not been successful with respect to quality control and with respect to production time because of the lack of uniformity in the material. For example, the center of the corner radius of a washcloth should be positioned to an accuracy of less than 0.060 to 0.100 inches. If the dimensions of the washcloth differ by more than this amount in either length or width, as is often the case, the comers will not be properly stitched and the labels will not be properly attached.

Attempts to automate the washcloth finishing process include U.S. Pat. No. 4,685,408 to Frye, disclosing the use of a plate to guide a pre-cut washcloth into a rotating sewing head. Frye, however, simply finishes each washcloth to a standard dimension and thus does not accommodate the dimensional variations of each washcloth. Further, Frye does not have the ability to change the center of rotation at the corners of the washcloth because of the mechanically-fixed rotation. Smaller washcloths generally need smaller comer radii. The use of a rotating sewing head is also disfavored by the industry because of the thrust and lateral loads that are created within the sewing head. The centrifugal forces imparted to the sewing head impair lubricant dispersal and the associated cooling effects such that high maintenance is required.

Other attempts to automate the washcloth finishing process include U.S. Pat. No. 5,018,462 to Brocklehurst. Brocklehurst discloses the maneuvering of a washcloth around a sewing head by the use of a rotating plate controlled by optical sensors. Rotation of the plate is activated by a sensor detecting a comer of the washcloth and continues until the next comer is detected. The desired position for the center of the radius of each corner, however, may not be the same for all four corners of the washcloth. Rather than accommodating the actual dimensions of the entire washcloth, the apparatus of Brocklehurst simply finishes each comer on same axis of rotation.

What is needed therefore is a means for accommodating nonuniform workpieces into an automated finishing system. Without this ability to adapt to the dimensions of each individual washcloth, even minor variations in the raw material can lead to an unsatisfactory product.

SUMMARY OF THE INVENTION

Stated generally, the invention comprises a method and apparatus for manufacturing a textile product from a continuous strip of material having a plurality of transverse borders positioned at equally spaced intervals so as to define a plurality of discrete panels. The apparatus includes pulling means for pulling the strip along a predetermined path. As the strip is advanced, detecting means determine the position of the transverse border for each of the panels. Straightening means straighten each of the transverse borders. Calculating means operatively associated with the detecting means and the pulling means then determine the length of each of the panels while measuring means determine the width. Cutting means then separate each of the panels from the strip based upon the detection of the transverse borders. After each panel is cut, maneuvering means disposed along a calculated path maneuver each of the panels through finishing means based upon the determination of the length and the width.

Specific embodiments of the invention include an apparatus that operates in sequential fashion to finish the edges of a washcloth. A continuous strip of terry cloth or similar material is fed into the apparatus. The material is straightened and then pulled along a predetermined path by a feed pull gripper. The position of the cut line on each individual washcloth is determined by a cut line detector. In the preferred embodiment, the cut line detector is an optical device. The washcloth is then cut by a cutting assembly and advanced to a predetermined location for maneuvering into the finishing area.

Based upon the position of the feed pull gripper at the time the detector senses the cut line of the washcloth, an axis Computer Numeric Controller ("CNC") determines the length of the washcloth. The width of the washcloth is also determined at the same time. The width is measured by an overhead camera as the washcloth advances along the predetermined path. The predetermined path has a reflective area thereon such that the camera can clearly locate the lateral edges of the washcloth.

After the washcloth is cut from the continuous strip and advanced to the predetermined location, the washcloth is engaged by a template attached to a gantry arm assembly. The template is lowered onto the exact center of the washcloth and maneuvers the washcloth along a calculated path into place adjacent to a sewing head. The template rotates the washcloth around the sewing head to finish the edges and comers of the washcloth. The template is guided by the controller based upon the determinations of length and width such that the washcloth is finished to its exact dimensions.

Thus, it is an object of the present invention to provide an improved method and apparatus for finishing a textile product.

It is another object of the invention to provide an improved method and apparatus for finishing a washcloth.

It is a further object of this invention to provide an automated method and apparatus for finishing washcloths which will accommodate washcloths of varying dimensions.

It is a still further object of the present invention to provide an improved method and apparatus to determine accurately the position of the cut line in a roll of terry cloth material and cut an individual washcloth from the roll along that cut line.

It is a still further object of the present invention to provide an improved method and apparatus to maneuver a washcloth into position and around a sewing head such that the comers of a washcloth are finished to uniform dimensions.

It is a yet another object of this invention to provide an improved method and apparatus for inserting labels into the edges or comers of a washcloth with a high degree of accuracy.

Other objectives, features and advantages of the present invention will become apparent upon reading a following specification, when taken in connection with the drawings and the claims.

DETAILED DESCRIPTION

Figure 1:
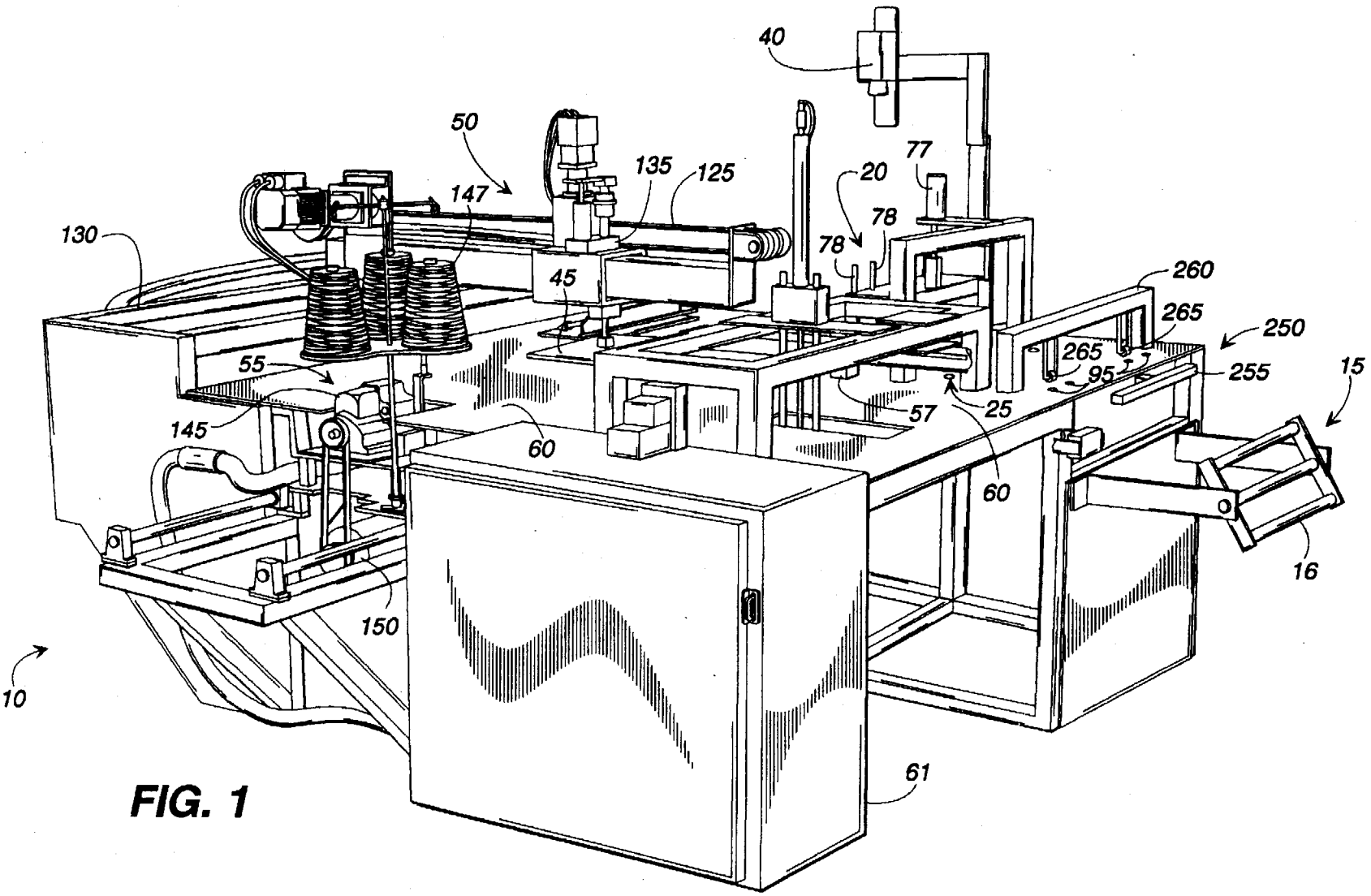
FIG. 1 is a perspective view showing the major elements of the preferred embodiment of the invention.
Figure 2:
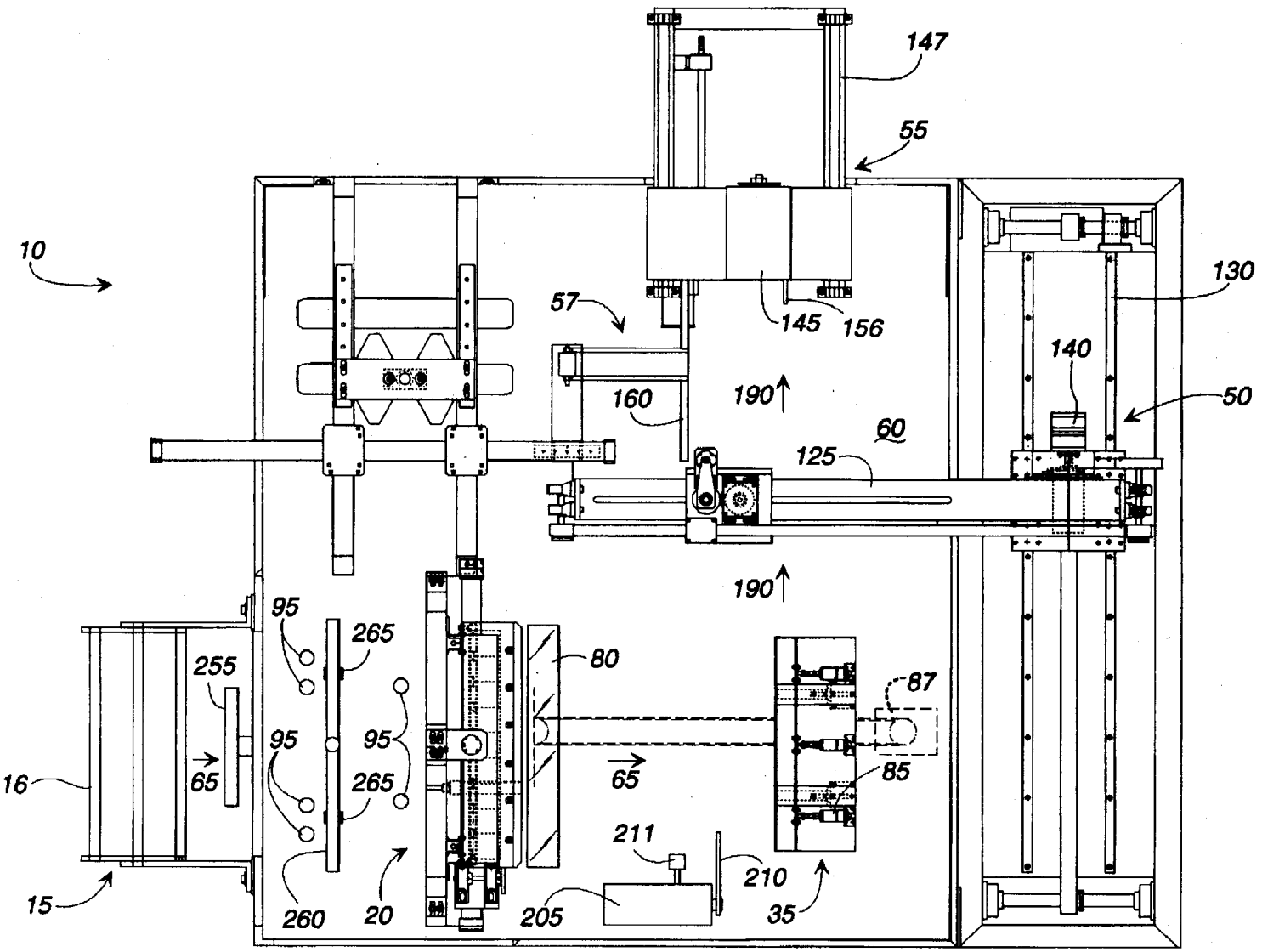
FIG. 2 is a plan view of the tabletop with the major elements of the preferred embodiment of the invention.
Figure 3:
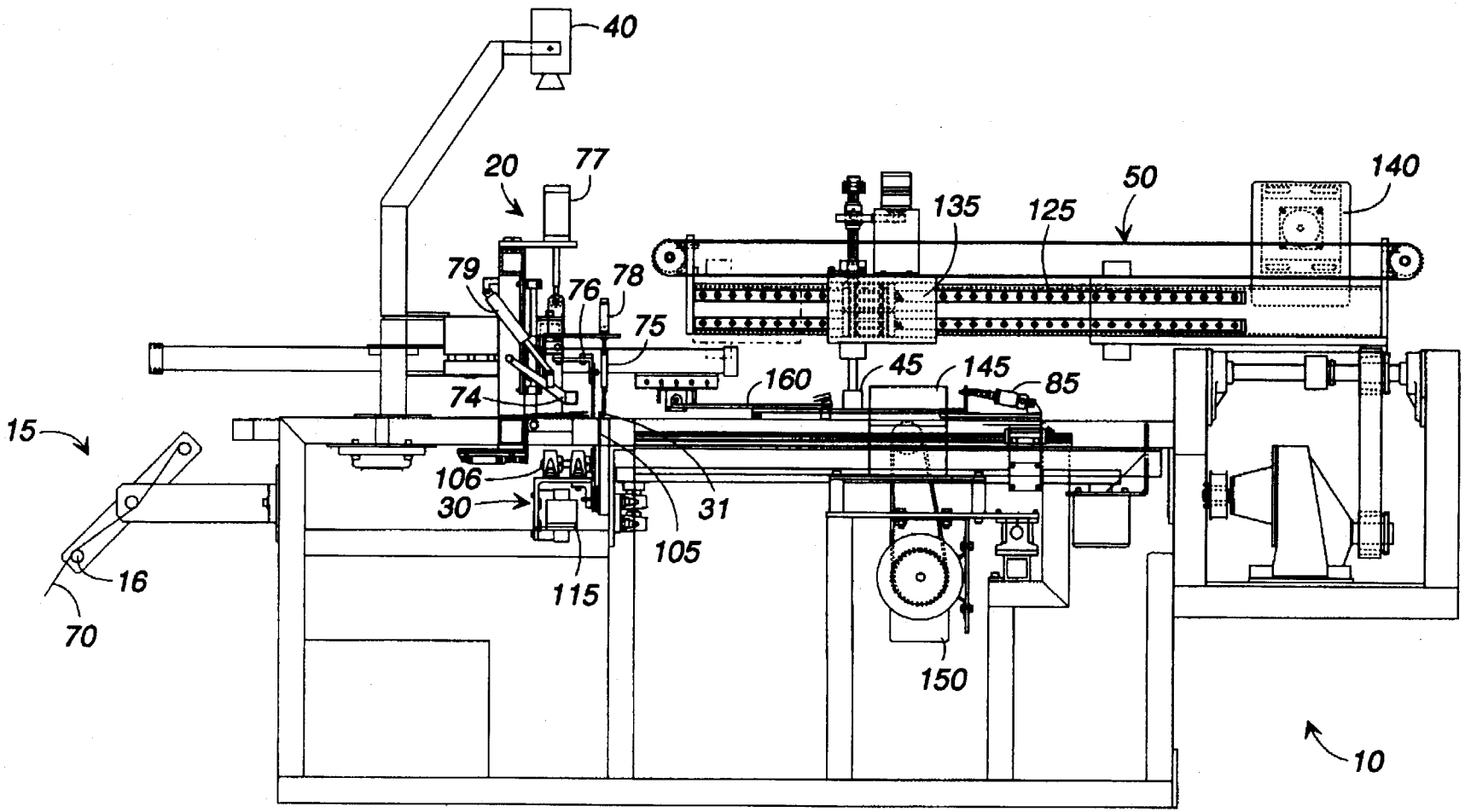
FIG. 3 is a side view of the tabletop, the intake assembly, the straightening gantry, the camera, the cutting assembly, the pull back assembly, the template, and the gantry frame assembly.

Referring to the drawings, in which like numerals represent like parts throughout the several views, FIGS. 1 through 7 show the preferred embodiment of a washcloth finishing apparatus 10. FIGS. 1 through 3 show the major elements of the apparatus 10. This embodiment of the invention employs the use of an intake assembly 15, a straightening gantry assembly 20, a detector assembly 25, a cutting assembly 30, a pull back assembly 35, a camera 40, a template 45, a gantry frame assembly 50, a sew area assembly 55, and a removal assembly 57. All of these elements are mounted on a table top 60 in sequential fashion as shown. Further, the table top 60 may contain multiples of any of the above-referenced elements, such as two intake assemblies 15, straightening gantry assemblies 20, detector assemblies 25, cutting assemblies 30, pull back assemblies 35, cameras 40, templates 45, and removal assemblies 57, cooperatively operating with a single or multiple sew area assemblies 55.

The operation of the invention as a whole is governed by an axis CNC controller 61. The controller 61 may be a Delta Tau PMAC-PC model motion controller system with an eight axis servo control card, manufactured by Delta Tau Data Systems, or a similar type of system.

The intake assembly 15 is mounted at one end of the table top 60 along an intake path 65. The intake assembly 15 accommodates a continuous strip 70 of terry cloth or other material as it is fed into the assembly 10. The intake assembly 15 has a set of bars 16 through which the continuous strip 70 is guided onto the intake path 65 on the table top 60.

Figure 8:
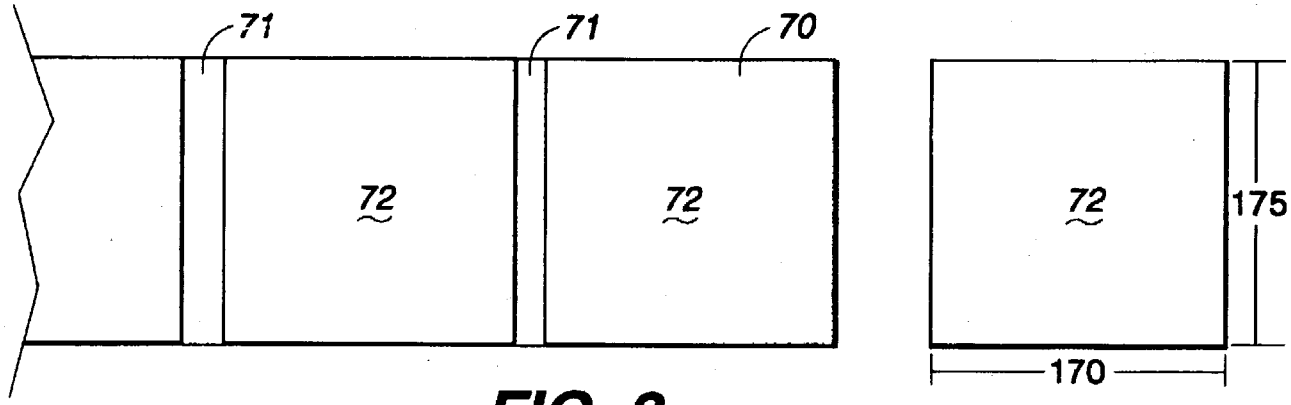
FIG. 8 is a plan view of a washcloth and the continuous strip of terry cloth material.

The continuous strip 70 is generally layered within a buggy or mounted in roll form. As is shown in FIG. 8, the continuous strip 70 has transverse borders or cut lines 71 present in essentially uniform intervals. The cut line 71 is an area in the continuous strip 70 with no terry loops or other plush material. The cut line 71 also may include a small gap or gaps in the fabric. The cut line 71 indicates where the continuous strip 70 is to be cut to form an essentially rectangular or square panel. In this embodiment, the panel is in the form of a washcloth 72.

Figure 4:
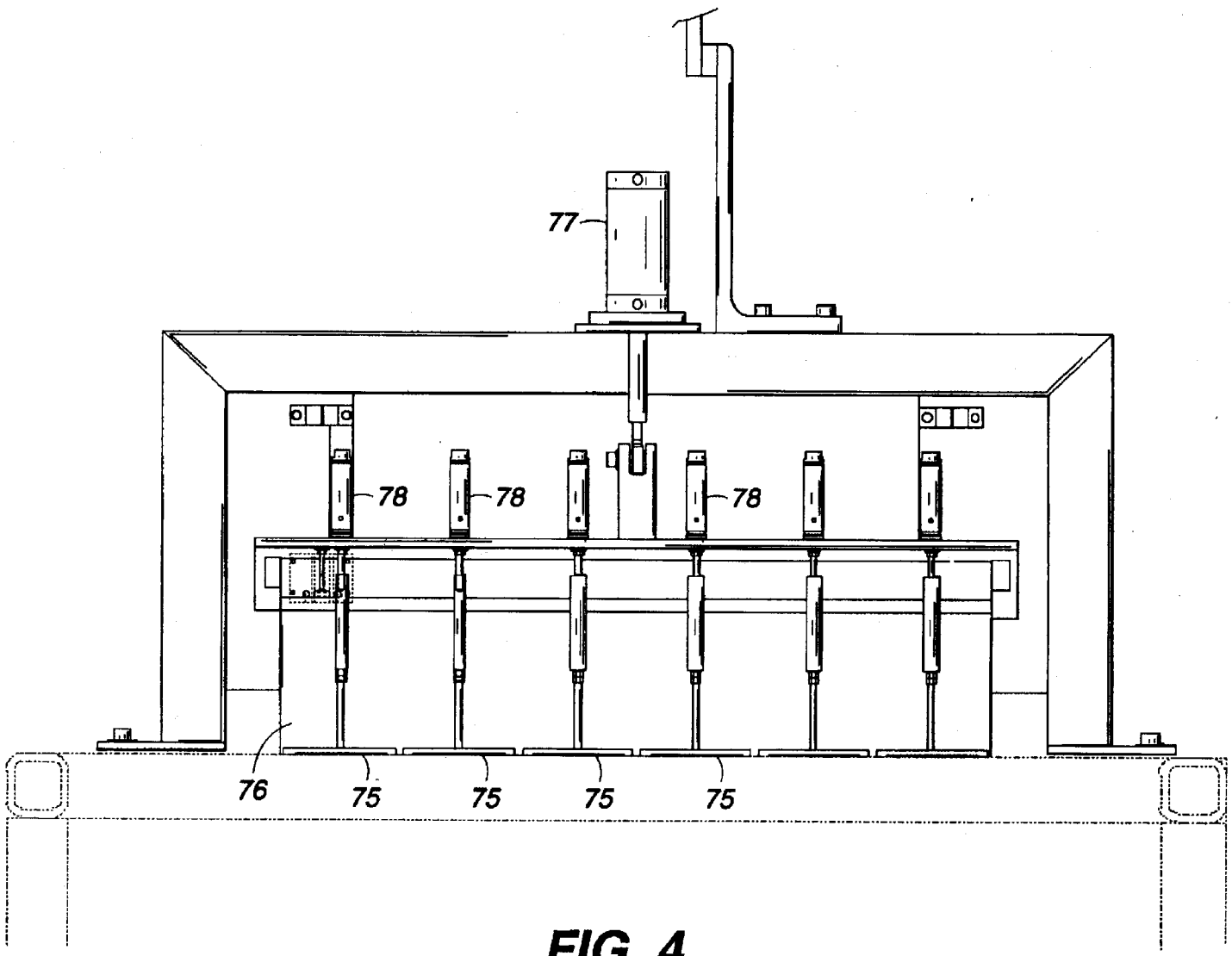
FIG. 4 is a front view of the straightening assembly.
Figure 5:
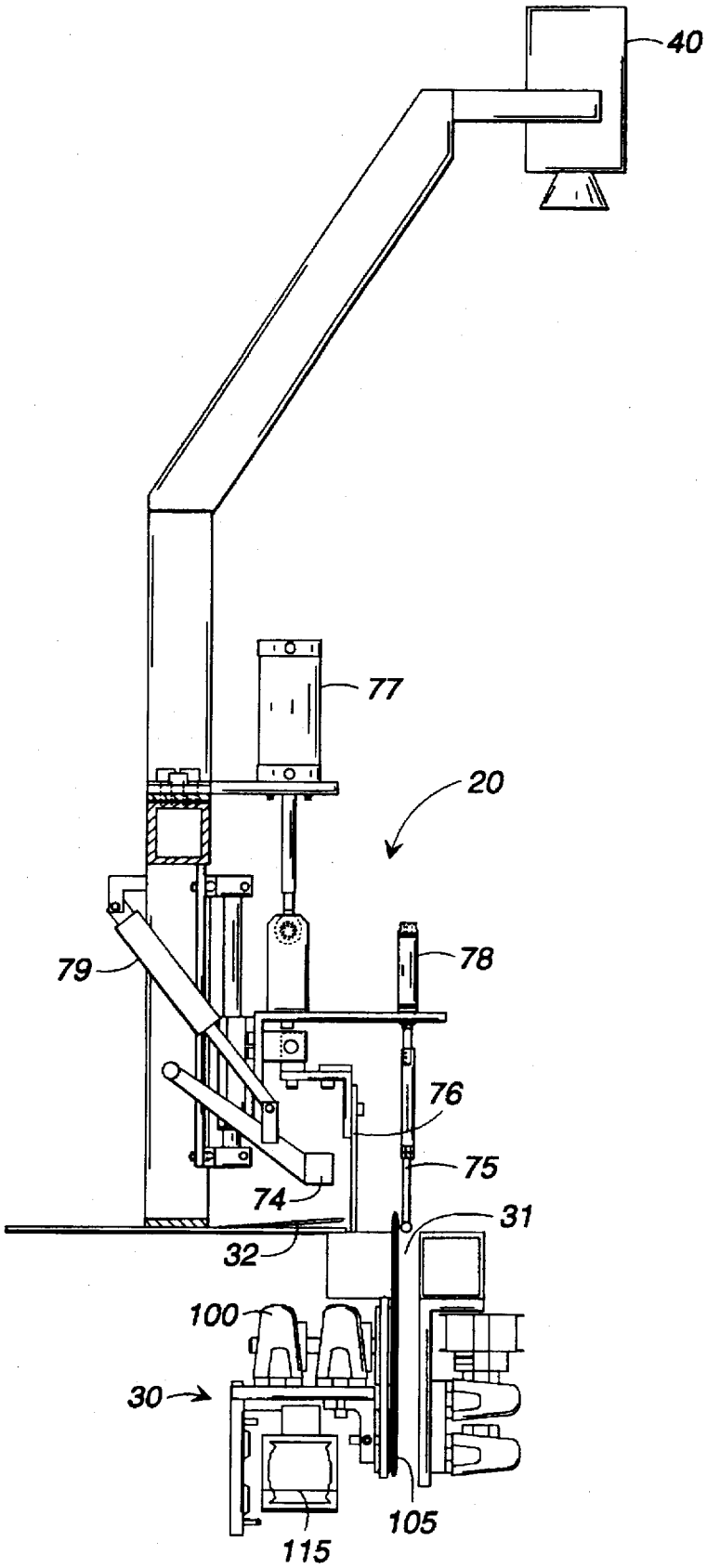
FIG. 5 is a side view of the straightening assembly, the cutting assembly, and the camera.
Figure 6:
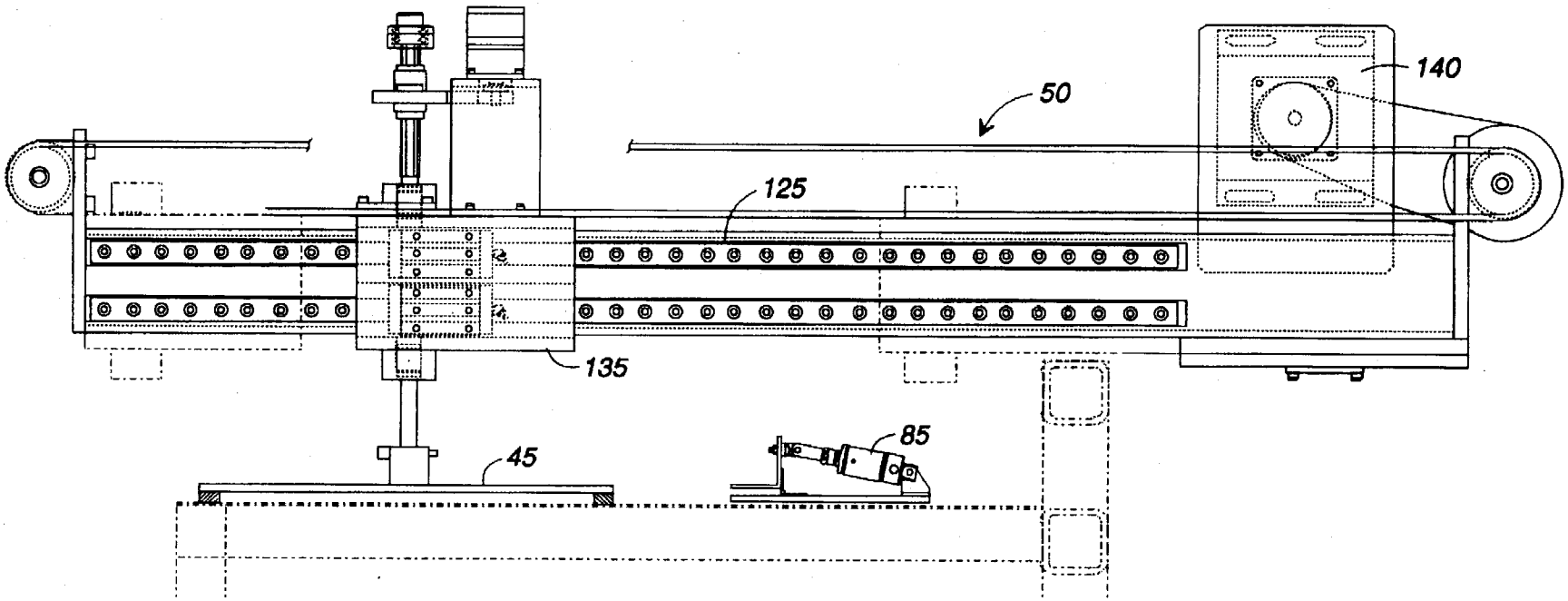
FIG. 6 is a side view of the pull back assembly, the template, and the gantry frame assembly.

As is shown in FIGS. 4 and 5, the straightening gantry assembly 20 is mounted to the table top 60 along the intake path 65. The straightening gantry assembly comprises a holding bar 74 with a holding bar air cylinder 79, several mechanical pusher rods 75 with pusher rod air cylinders 78, and a straightening plate 76. The mechanical pusher rods 75 and the straightening plate 76 are in turn mounted to an assembly air cylinder 77.

The mechanical pusher rods 75 are generally in the shape of a inverse "T" and are positioned over a recess 31 adjacent to the cutting assembly 30. The straightening plate 76 is rectangularly shaped and extends the width of the intake path 65. The pusher rods 75 and the straightening plate 76 are powered by the assembly air cylinder 77 for up and down motion therewith. The pusher rods 75 are further powered by the pusher rod air cylinders 78 for extended motion into the recess 31. The holding bar 74 is positioned behind the straightening plate 76 and is powered for up and down motion by the holding bar air cylinder 79.

As is shown in FIG. 3, the camera 40 is mounted upon the straightening gantry assembly 20 such that the camera 40 has a view of the intake path 65 from the straightening gantry assembly 20 to the pull back assembly 35. The camera 40 can be any kind of conventional camera, photo-eye, or other optical monitoring device. The intake path 65 has a reflective surface 80, such as a piece of reflective tape, thereon to ensure that the camera 40 can differentiate between the intake path 65 on the table top 60 and the continuous strip 70.

The pull back assembly 35 is mounted on the table top 60 along the intake path 65. The pull back assembly 35 comprises a feed pull gripper 85 attached to a servo motor 87. More than one feed pull gripper 85 may be employed within the pull back assembly 35. The feed pull gripper 85 grabs the continuous strip 70 as it is emerges from the straightening gantry assembly 20 and pulls the continuous strip 70 along the intake path 65 through the cutting assembly 30 and onto a predetermined location on the table top 60.

The detector assembly 25 determines the location of the cut line 71 and other boundaries of the washcloth 72. The detector assembly 25 includes two optical sensors 95 positioned along the intake path 65 of the table top 60. In this embodiment, the optical sensors 95 are analog photo-eyes that can detect changes in the thickness or density of the continuous strip 70. The analog output of the optical sensors 95 to the controller 61 changes proportionally to the thickness or density of the cloth. The optical sensors 95 can be used with any thickness or color of cloth. Alternatively, any type of detector controls may be employed, including optical, electrical, or pneumatic. One or more detector assemblies 25 may be used.

In connection with the detector assembly 25, the straightening gantry assembly 20 also may include a bias correction device 250 to ensure that the position of the cut line 71 is straight as it approaches the cutting assembly 30. The bias correction device 250 comprises a straightening bar 255 mounted on the table top 60 adjacent to the intake assembly 15, and an edge guide apparatus 260 positioned between the straightening bar 255 and the cutting assembly 30. The bias correction device 250 also employs the use of the optical sensors 95. Because at least two optical sensors 95 are used, the sensors 95 also can determine whether the cut line 71 is perpendicular to the intake path 65. Any angle or bias in the cut line 71 can be determined by measuring the timing of the change in output of the two sensors 95. This difference causes the controller 61 to tilt the straightening bar 255 in one direction or another to compensate for the bias in the continuous strip 70.

The edge guide apparatus 260 comprises two rotatable wheels 265 that descend along the edge of the continuous strip 70 to ensure that the absolute edges on both sides of the continuous strip 70 remain along the same line. The edge guide apparatus also comprises several additional optical sensors 95 positioned along the edge of the continuous strip 70 because the continuous strip 70 tends to move to the right or the left when the straightening bar 255 corrects the bias therein. The optical sensors 95 detect any drift in the continuous strip 70 and activate the rotatable wheels 265 accordingly.

As is shown in FIG. 5, the cutting assembly 30 is positioned under the table top 60 in the middle of the recess 31 in the intake path 65. The intake path 65 has a raised plate 32 positioned thereon just prior to the recess 31. The cutting assembly 60 comprises a blade 105 powered by an electrical motor 106. The blade 105 is also attached to and activated by a cutting blade air cylinder 115 for reciprocal movement along the recess 31. The blade 105 is activated for movement along the recess 31 by a signal from the controller 61 to coincide with the depression of the pusher rods 75 to accurately cut the washcloth 72.

The gantry arm assembly 50 is positioned on the table top 60 and comprises a gantry arm 125, one or more fixed rails 130, a template frame 135, and the template 45. The template 45 is operably mounted within the template frame 135 for rotation about the Z, or vertical, axis. The template 45 also can be raised or lowered towards the table top 60 so as to engage the washcloth 72. The template frame 135 is supported by the gantry arm 125 for movement thereon along the Y axis. The gantry arm 125 is mounted on the one or more fixed rails 130 for movement thereon along the X axis. The result is that the template 45 can maneuver along the X, Y, and Z axes and also rotate about the Z axis. The template 45 is powered by one or more electrical drive motors 140. The drive motors 140 are governed by directional instructions received from the controller 61 such that the washcloth 72 is maneuvered along a calculated path 190, described below.

Figure 7:
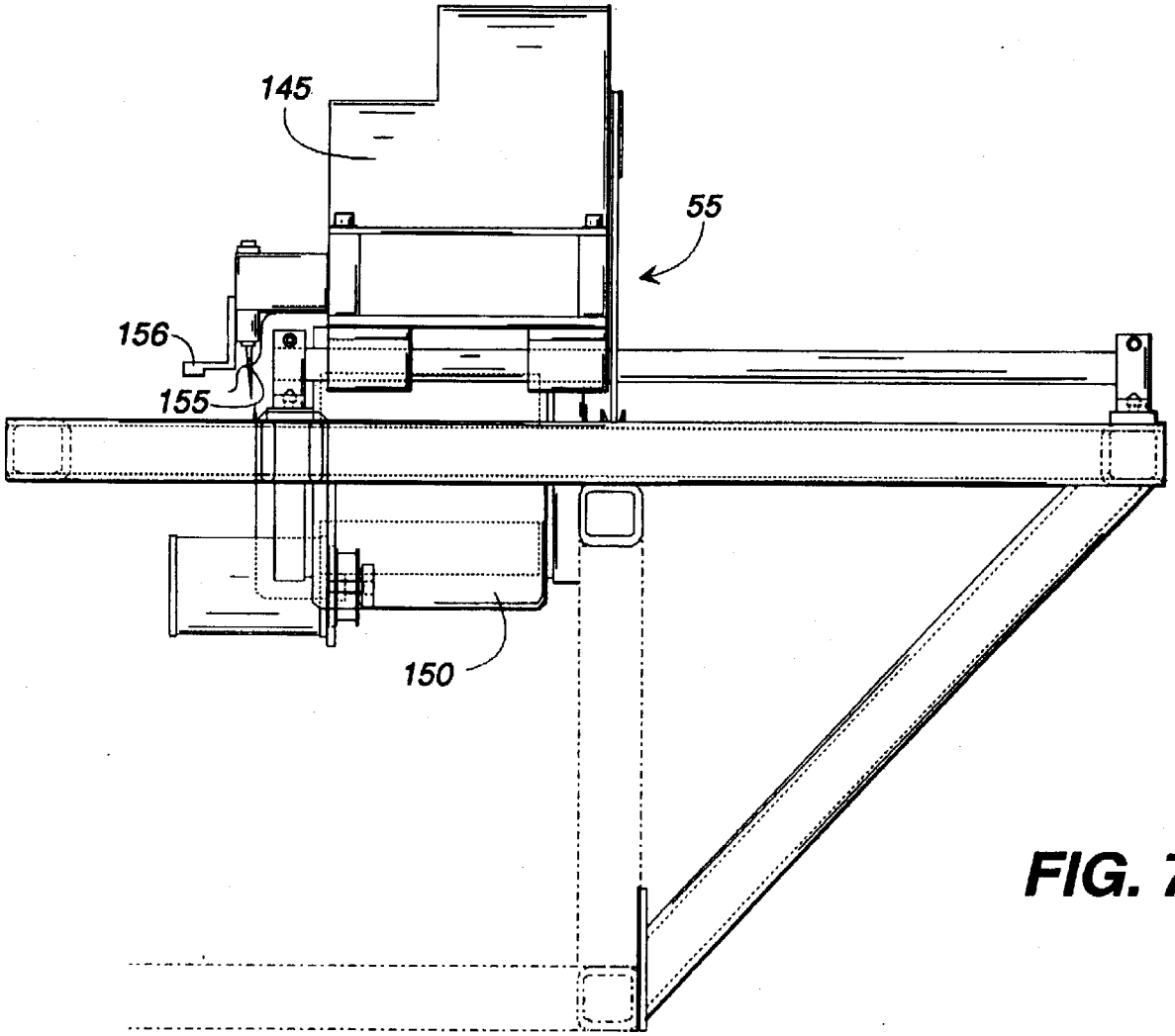
FIG. 7 is a side view of the sewing assembly.

The sew area assembly 55 is also mounted on the table top 60 as is shown in FIG. 7. The sew area assembly 55 includes a sewing head 145 powered by a sewing motor 150. The sewing motor 150 is generally a two horsepower electrical motor. A Mauser brand or similar sewing head may be employed. The sewing head 145 is fed with thread from spindles 147. The sewing head 145 may be equipped with an integral blade 155 and a spring-loaded tracking arm 156. The sew area assembly 55 also may be equipped with more than one sewing head 145 depending upon the number of elements mounted on the table top 60. Further, more than one type of sewing head 145 may be employed to give the apparatus 10 versatility in accommodating various types of washcloths 72.

The removal assembly 57 is mounted on the table top 60 adjacent to the sew area assembly 55. The removal assembly 57 comprises a "T" shaped engagement arm 160 capable of reciprocal movement. The engagement arm 160 engages the washcloth 72 by pulling it along the table top 60 after the template 45 has maneuvered the washcloth 72 around the sewing head 145. The engagement arm 160 pulls the washcloth along the table top 60 to a predetermined placement location.

In the preferred embodiment of FIGS. 1 through 7, the washcloth finishing apparatus 10 processes the continuous strip 70 in sequential fashion. The continuous strip 70 is positioned in the intake assembly 15 and advanced along the intake path 65. One end of the continuous strip 70 is fed into the straightening gantry assembly 20 and engaged by the feed pull gripper 85. The straightening gantry assembly 20 ensures that the incoming cut line 71 on the continuous strip 70 is perpendicular to the intake path 65 and parallel to the cutting assembly 30 by the use of the straightening plate 76. The straightening plate 76 descends upon the fabric and intersects the cut lines 71. The cut lines 71 are forced against the plate 76 as the feed pull gripper 85 pulls the continuous strip 70 forward to remove any angle or bow that may be present. The pusher rods 75 then descend and force the continuous strip 70 into the recess 31 adjacent to the cutting assembly 30. The holding bar 74 secures the continuous strip 70 behind the straightening plate 76 to ensure that the continuous strip 70 remains in place as the washcloth 72 is cut.

As the continuous strip 70 advances along the intake path 65, the location of each cut line 71 is determined by the optical sensors 95 of the washcloth detector assembly 25. The cut line 71 is of lesser density then that of the surrounding plush fabric of the continuous strip 70. The optical sensors 95 determine the position of the cut line 71 by sensing the change in density of the continuous strip 70. When the cut line 71 passes over the optical sensors 95, the output of the sensors 95 changes in magnitude and duration. This change is monitored and the position of the cut line 71 is determined by the controller 61.

This determination of the position of cut line 71 by the optical sensors 95 also may be used by the bias correction device 250 to further ensure that the cut line 71 is straight before the continuous strip 70 reaches the cutting assembly 30. Any difference in the timing of the detection of the cut line 71 by the respective optical sensors 95 causes the straightening bar 255 to correct the bias in the continuous strip 70 by tilting in the opposite direction from the bias. The edge guide apparatus 260 keeps the edges of the continuous strip 70 in line while the straightening bar 255 is tilted.

As the continuous strip 70 is advanced by the feed pull gripper 85 through the cutting assembly 30, the blade 105 is triggered by the determination of the position of the cut line 71. The controller 61 is aware of the exact position of the cut line 71 at all times based upon the detection of the cut line 71 by the detector assembly 25. Based upon this information, the feed pull gripper 85 advances the continuous strip 70 such that the blade 105 cuts an individual washcloth 72 exactly at the location of the cut line 71. The washcloth 72 is then pulled by the feed pull gripper 85 to a predetermined location at the intersection of the end of the intake path 65 and the beginning of the calculated path 190 and released.

The length 170 of each washcloth 72 is calculated based upon the determination of the location of the cut line 71. The controller 61 calculates the exact length 170 of each washcloth 72 based upon the position of the feed pull gripper 85 along the intake path 65 at the time the detector assembly 25 senses the presence of a cut line 71, in combination with the known amount of advance of the feed pull gripper 85.

The width 175 of each individual washcloth 72 is also determined as the continuous strip 70 advances along the intake path 65. The width 175 is measured by the overhead camera 40 mounted to the straightening gantry assembly 20. The intake path 65 has a reflective surface 80 thereon such that the camera 40 can locate the edges of each washcloth 72 and measure the width 175. Approximately three measurements are taken for the width 175 of each washcloth 72 as the continuous strip 70 is advanced. These sums are averaged and the width 175 of each washcloth 72 is determined by the controller 61. The camera 40 can be any type of device by which the perimeter of each washcloth 72 can be determined, such as video monitoring, imaging, or the use of a photo-electrical beam.

Based upon the determination of the length 170 and the width 175 for the washcloth 72, and the distance traveled by the feed pull gripper 85, the exact center 185 of the washcloth 72 is also known. The washcloth 72 is then engaged at its center 185 by the template 45 associated with the gantry frame assembly 50. The template 45 maneuvers the washcloth 72 along the calculated path 190 into position in the sewing area assembly. As described above, the gantry arm 125, in combination with the template 45, permits maneuvering of the washcloth 72 along the calculated path 190 in both the X and the Y axes. The template 45 also can rotate about the Z axis within the template frame 135.

Once the washcloth is maneuvered into position in the sewing area 55, the template 45 rotates the washcloth 72 around the sewing head 145 to finish the edges and the corners of the washcloth 72. The sewing head 145 stitches each edge of the washcloth 72 based upon the determination of the length 170 and the width 175. The corners of each washcloth 72 are also automatically rounded. Another camera 40 or further optical sensors 95 also can be located over the sew area assembly 55 and provide information regarding out of square edges on the washcloth 72. In this embodiment, optical sensors 95 are mounted adjacent to the sewing head 145. Out of square edges are detected by the optical sensors 95 and are compensated for as the washcloth 72 is maneuvered around the sewing head 145.

By positioning two optical sensors 95 adjacent to the sewing head 145, the sensors 95 can also detect the exact location of a corner of the washcloth 72 so as to accurately cause the template 45 to begin to rotate. As the turn is completed, the optical sensors 95 accurately detect the position and depth of the next side of the washcloth 72. In this manner, any angle in the washcloth 72 is accounted for to ensure that the sewing head 145 does not does not miss an edge or a corner and the washcloth 72 is evenly finished.

As the sewing head 145 advances around the washcloth 72, the sewing head 145 is kept in position with the help of the tracking arm 156. The tracking arm 156 rides along the template 45 and forces the template 45 to hold the washcloth 72 in position. When each edge of the washcloth 72 is finished, the sewing head 145 "sews off" or slightly overlaps the stitches to prevent the stitches from unraveling. As the washcloth 72 is maneuvered around the sewing head 145, the integral blade 155 also cuts away any excess material.

Figure 9:
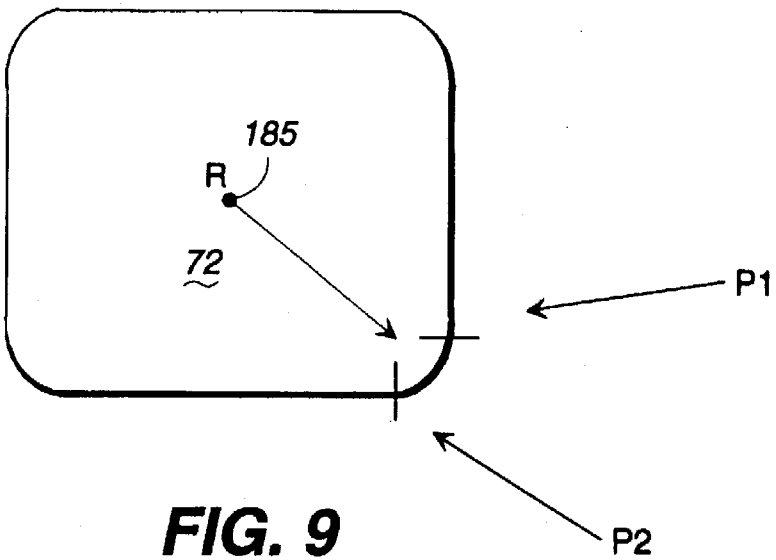
FIG. 9 is a plan view of a washcloth.

As is shown in FIG. 9, the starting point of the arc P1, the center of rotation R, and the ending point of the arc P2 are calculated for each comer of the washcloth 72 using the known speed of the template 45 and other experimentally-determined coordinates. The operator of the apparatus 10 also has the ability to modify the position of the starting point of the arc P1. This gives the operator the ability to control how "round" a given corner is finished. The operator also can change the speed in which the sewing head 145 advances along the sides of the washcloth 72 to accommodate washcloths 72 of varying thickness and density.

The engagement arm 160 of the removal assembly 57 then engages the washcloth 72 and pulls it to the side of the table top 60 for removal from the apparatus 10. The removal assembly 57 also may drop the washcloth 72 into a holding area (not shown) for stacking.

By determining the dimensions of the washcloth 72 to a high degree of accuracy, the apparatus 10 is also able to insert labels 200 onto the edges or corners of the washcloth 72. A label insertion apparatus 205 with a rotating arm 210 may be positioned adjacent to the intake path 65. As the washcloth 72 is released by the feed pull gripper 85 at the predetermined location, the rotating arm 210 of the label insertion apparatus 205 may place a label 200 on one side of the washcloth 72. The template 45 secures the label 200 on the washcloth 72 and the label 200 is sewn into position as the washcloth 72 travels around the sewing head 145. Alternatively, the label insertion apparatus may include a plate 211 in which the labels 200 are positioned. The plate 211 is extended by the label insertion apparatus 205 into position over the washcloth 72 where the plate 211 releases the label 200. More than one label 200 can be inserted on a washcloth 72.

As an alterative embodiment, the sewing head 145 itself is capable of rotation about the Z axis. The movement of the template 45 can then be limited to two directions of movement. The template 45 advances the washcloth 72 adjacent to the sewing head 145 and the controller 61 then guides the sewing head 145 and the template 45 based upon the predetermined length 170 and width 175 dimensions.

Further, the camera 40 or other detection device also can be located over the sew area assembly 55 and receive information on both the length 170 and the width 175 of the washcloth 72. This information on the dimensions of the washcloth 72 may then be used by the controller 61, as described above, to guide the washcloth 72 through the sewing head 145. The camera 40 can determine the dimensions of the entire washcloth 72 to guide the template 45 and the washcloth 72 around the sewing head 145 regardless of the means for cutting each washcloth 72 from the continuous strip 70. Likewise, the sewing head 145 itself can maneuver in and out to compensate for variations in the edges. By using this information, the sewing head 145 can track and follow the actual edge of the washcloth 72.

The result of these embodiments is an apparatus 10 capable of producing a high quality washcloth 72 finished to its exact dimensions. Such a finish is ensured by the determination of the dimensions of each washcloth 72 by the controller 61 to guide the template 45. The controller 61 can react to varying dimensions and also permit size changes without the need for mechanical alterations to the apparatus 10. The apparatus 10 can finish the edges of washcloths 72 ranging in length from 11 to 15 inches. An average of 6 to 6.5 washcloths per minute can be produced based upon a 12 inch washcloth 72.

While the invention has been disclosed as finishing the edges of terry cloth washcloths, other types of fabric and materials can be used. Likewise, the invention can finish the edges of products other than washcloths, such as napkins, towels, place mats, floor mats, rugs, and the like.

We claim:

1. A bias correction device to remove any bias in the position of a cut line on a continuous strip of cloth as said continuous strip of cloth advances along a predetermined path, comprising:

at least two detecting devices located along said predetermined path to detect any bias in said position of said cut line;

a straightening bar mounted on said predetermined path to tilt said continuous strip in the opposite direction to said bias to compensate for said bias.

2. The bias correction device of claim 1 wherein said detecting devices comprise optical sensors.

3. The bias correction device of claim 1 further comprising an edge guide apparatus located on said predetermined path to ensure that the edges of said continuous strip maintain their position along said predetermined path.

4. A bias correction device to remove any bias in the position of a cut line on a continuous strip of cloth as said continuous strip of cloth advances along a predetermined path, comprising:

at least two detecting devices located along said predetermined path to detect any bias in said position of said cut line;

a straightening bar mounted on said predetermined path to tilt said continuous strip in the opposite direction to said bias to compensate for said bias; and an edge guide apparatus located on said predetermined path to ensure that the edges of said continuous strip maintain their position along said predetermined path, said edge guide apparatus comprises two or more rotating wheels that ride along said edges in said continuous strip.

5. A bias correction device for a textile strip with cut lines thereon forming discrete panels, comprising:

means for moving said textile strip along a predetermined path having lateral boundaries;

means for detecting any bias in the position of said cut lines on said textile strip with respect to a line perpendicular to said predetermined path; and straightening means positioned along said predetermined path to reorient said textile strip to maintain said cut lines in alignment with said line perpendicular to said predetermined path;

whereby any bias in said cut lines as determined by said detecting means is eliminated.

6. The bias correction device of claim 5, wherein said means for detecting said any bias in the position of said cut lines comprises at least one optical sensor on each of said lateral boundaries of said predetermined path, whereby said optical sensor detects the border between said cut lines and said discrete panels.

7. The bias correction device of claim 6, wherein said means for detecting said any bias in the position of said cut lines determines said bias by detecting the difference in the timing of the output of said optical sensors on each of said lateral boundaries of said predetermined path as said cut lines are advanced along said predetermined path.

8. The bias correcting device of claim 5 wherein said straightening means comprises a straightening bar in frictional engagement with said textile strip, said straightening bar mounted on said predetermined path to tilt said continuous strip to compensate for said bias.

9. The bias correcting device of claim 8 wherein said straightening bar tilts with respect to said predetermined path to reorient said cut lines with respect to said line perpendicular to said predetermined path.

* * * * *